United States Patent [19]

Shiuh-Shinn

[11] Patent Number: 5,064,189

[45] Date of Patent: Nov. 12, 1991

[54] EXERCISE APPARATUS FOR GENERATING HARMONIC RESISTANCE TO AN EXERCISER

[76] Inventor: Jiang Shiuh-Shinn, No. 179, Sec. 2, Chung Hua Rd., Taichung, Taiwan

[21] Appl. No.: 436,740

[22] Filed: Nov. 15, 1989

[51] Int. Cl.[5] ..... A63B 21/00

[52] U.S. Cl. ..... 272/72; 272/141

[58] Field of Search ..... 272/72, 73, 141, 142, 272/93, 132

[56] References Cited

U.S. PATENT DOCUMENTS 4,541,627 9/1985 MacLean et al. ..... 272/72

4,583,731 4/1986 Crivello et al. ..... 272/141

*Primary Examiner*—Stephen R. Crow

*Attorney, Agent, or Firm*—Cushman, Darby & Cushman

[57] ABSTRACT

A gymnastic apparatus capable of generating a harmonic resistance to an exerciser comprises mainly an elongated guiding screw rod and a transverse shaft. The guiding screw rod comprises thereon a moving block capable of moving along the screw thread of the guiding screw rod to compress the coiled spring. The moving block includes a straight rod having a collision element arranged at each end thereof for the purpose of triggering the rocking levers of the reversing members. The transverse shaft is composed of two sliding blocks pivotally and respectively arranged on two spline sleeves. Located at one end of the spline sleeve is a clutch member, which engages with the bevel wheel so as to enable the bevel wheel to drive the guiding screw rod. At the outset, an exerciser's reciprocating motion of driving two rowing arms actuates the transverse shaft to turn in one direction so as to initiate the rotation of the guiding screw rod, which in turn triggers the moving block to move along the screw thread of the guiding screw rod to compress the coiled spring until such time when the intensity of recoil force of the compressed spring has reached a predetermined maximum degree. Thereafter, the reversing members are triggered by collision elements of the straight rod to alter the direction, in which the guiding screw rod rotates, to bring about the retreat of the moving block to release the compressed spring until the reversing members are activated again. Therefore, the reciprocating actions of compressing and decompressing the coiled spring result in a cyclic generation of a harmonic resistance to an exercier's hands.

2 Claims, 2 Drawing Sheets

EXERCISE APPARATUS FOR GENERATING HARMONIC RESISTANCE TO AN EXERCISER

BACKGROUND OF THE INVENTION

The present invention relates to a gymnastic apparatus, and more particularly to a gymnastic apparatus capable of generating harmonic opposing forces against an exerciser.

It is a generally accepted principle of physical training that a person does an exercise in a simple harmonic manner that the magnitude of opposing force exerting on him or her is preferably increased progressively to reach a maximum opposing force, and is thereafter allowed to reverse gradually to reach a minimum opposing force.

SUMMARY OF THE INVENTION

It is, therefore, the primary objective of the present invention to provide a gymnastic apparatus capable of generating harmonic opposing force against an exerciser so as to reinforce the effectiveness of a gymnastic exercise.

It is another objective of the present invention to provide a gymnastic apparatus with means permitting a user thereof to adjust at will the magnitude of opposing force exerting on a user.

In keeping with principles of the present invention, the primary objectives of the present invention are accomplished by a gymnastic apparatus capable of generating a harmonic resistance to an exerciser. The gymnastic apparatus of the present invention comprises mainly a transmission mechanism, which is composed of an elongated guiding screw rod and a transverse shaft. The guiding screw rod comprises thereon a moving block capable of moving along the screw thread of the guiding screw rod to compress a coiled spring. The moving block includes a straight rod having a collision element arranged at each end thereof for the purpose of triggering rocking levers of reversing members. The transverse shaft is composed of a set of transmission elements arranged at both ends thereof. The transmission elements include two sliding blocks pivotally and respectively arranged on two spline sleeves 36 and 38. Located at one end of the spline sleeve is a clutch member, which engages with a bevel wheel so as to enable the bevel wheel to drive the guiding screw rod. At the outset, an exerciser's reciprocating motion of driving two lever rowing arms 71 of an exercise device such as a rowing machine having rowing arms (not shown) actuates the transverse shaft to turn in one direction so as to initiate the rotation of the guiding screw rod, which in turn triggers the moving block to move along the screw thread of the guiding screw rod to compress the spring until such time when the intensity of recoil force of the compressed spring has reached a predetermined degree. Thereafter, the reversing members are triggered by collision elements of the straight rod to alter the direction, in which the guiding screw rod turns, in order to bring about the retreat of the moving block to release the compressed spring until the reversing members are activated again. Therefore, the reciprocating actions of compressing and decompressing the spring result in a cyclic generation of a harmonic opposing force against an exerciser.

DETAILED DESCRIPTION OF THE PREFERRED EMBODIMENT

Figure 1:
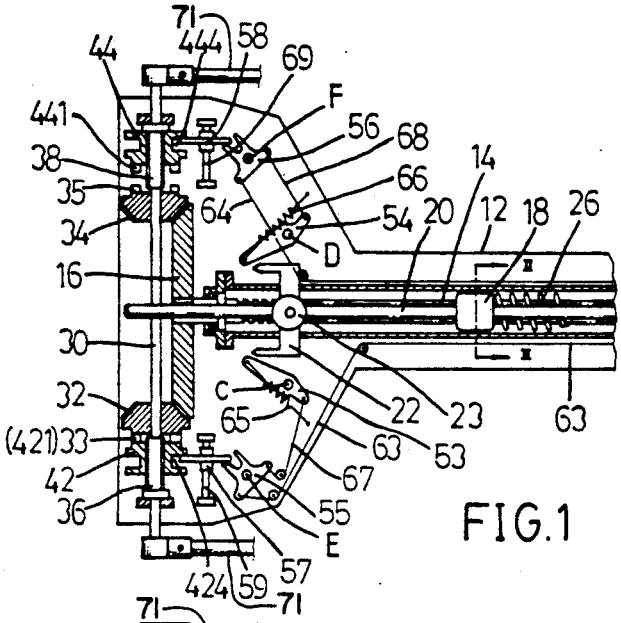
FIG. 1 shows a schematic plane view illustrating the preferred embodiment of the present invention at its initial state of action.
Figure 2:
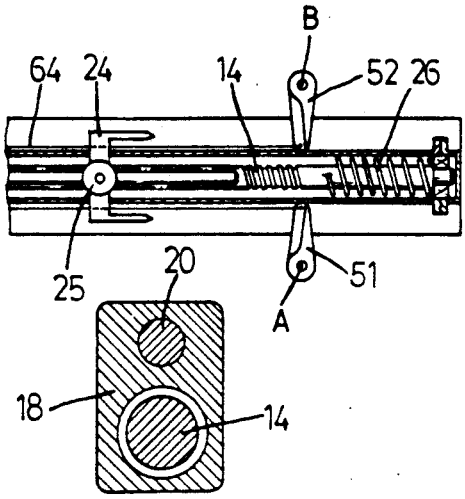
FIG. 2 shows a cut-away view of the portion taken along line II—II as shown in FIG. 1.

Referring to FIGS. 1 and 2, the gymnastic apparatus embodied in the present invention is shown comprising a base 12 having an elongated guiding screw rod 14 arranged longitudinally therein. The guiding screw rod 14 includes a first bevel wheel 16 mounted fixedly at one end thereof and a moving block 18 disposed at the mid-section thereof. A straight rod 20 is arranged on the moving block 18 and is positioned parallel to the guiding screw rod 14, as shown in FIG. 2. Located respectively at both ends of the straight rod 20 are two U-shaped collision elements 22 and 24, which are pivotally mounted on the straight rod 20 and are thus capable of moving along the straight rod 20 to the designated positions where they are locked up on the straight rod 20 by means of revolving buttons 23 and 25. In addition, one end of the guiding screw rod 14 is encased with a coiled spring 26, which is subject to a compression by the moving block 18.

A transverse shaft 30 is located perpendicularly to the guiding screw rod 14 and has second and third bevel wheels 32 and 34 mounted pivotally thereon. Each of these two bevel wheels 32 and 34 comprises respectively clutch members 33 and 35 disposed at the journal ends thereof. In addition, the transverse shaft 30 comprises two spline sleeves 36 and 38 fastened thereto at both ends thereof. The spline sleeves 36 and 38 are used to receive respectively two sliding blocks 42 and 44, which are of identical constructions with H-shaped cross sections. The sliding blocks 42 and 44 are composed of clutch members 421 and 441 located at both ends thereof and circular grooves 424 and 444 arranged at the centers thereof.

Two sets of reversing members are arranged at both sides of the guiding screw rod 14. The reversing members include the first and the second rocking levers 51 and 52 arranged at both sides in the vicinity of one end of the guiding screw rod 14 and the third and the fourth rocking levers 53 and 54 disposed similarly at both sides near other end of the guiding screw rod 14. Furthermore, the reversing members also include two actuating elements 55 and 56 engaging with two sliding pieces 57 and 58 respectively. The coordinated operation of the components mentioned above is further expounded hereinafter.

Using the pivot pins A and B as fulcrums, the first and the second rocking levers 51 and 52 are capable of turning about. However, the orientations of the first and the second rocking levers 51 and 52 are confined by the springs (not shown in the drawings provided). Each of the first and the second rocking levers 51 and 52 is fastened respectively to reacting cables 63 and 64 at one end thereof while the other ends of reacting cables 63 and 64 are fastened respectively to actuating elements 55 and 56 via plurality of guide wheels (not shown). The third and the fourth rocking levers 53 and 54 are capable of turning about by using pivot pins C and D as fulcrums. The orientations of the third and the fourth rocking levers 53 and 54 are confined by the coiled springs 65 and 66, as shown in FIG. 1. Each of the third and the fourth rocking levers 53 and 54 is fastened respectively to reacting cables 67 and 68 at one end thereof while the reacting cables 67 and 68 are in turn fastened respectively to actuating elements 55 and 56 at other end thereof. Using the pivot pins E and F as fulcrums, the actuating elements 55 and 56 are able to turn so as to actuate the sliding pieces 57 and 58 to make a reciprocating motion on the guide rods 59 and 69.

The operation of the preferred embodiment of the present invention is explained explicitly hereinafter.

Figure 3:
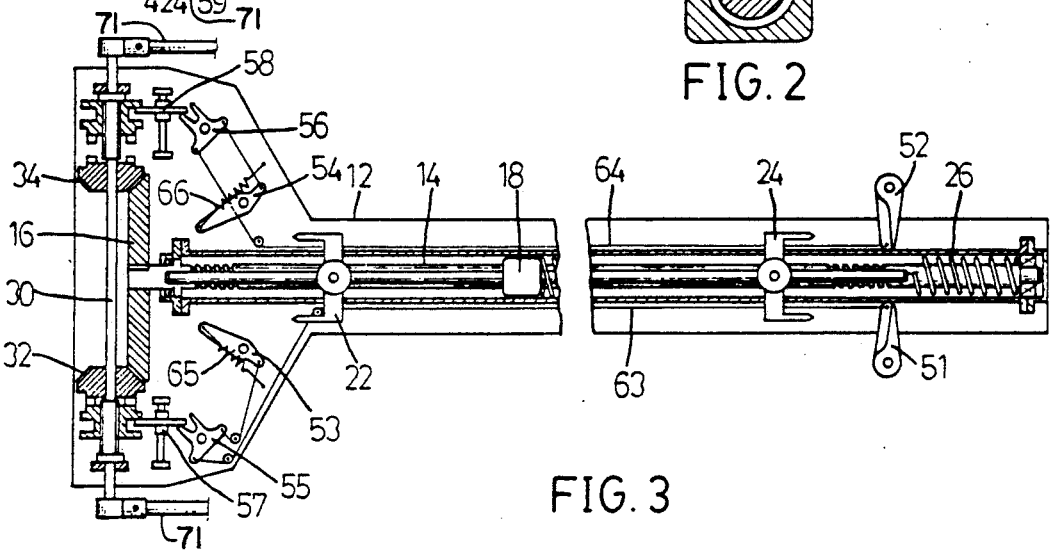
FIG. 3 shows a schematic plane view of the preferred embodiment of the present invention in action.

As shown in FIG. 1, an inward movement of the sliding block 42 actuated by the sliding piece 57 will trigger the clutch member 421 of the sliding block 42 to engage with the clutch member 33 of the second bevel wheel 32. On the other hand, the sliding piece 58 actuates the sliding block 44, which in turn triggers the clutch member 441 thereof to disengage with the clutch member 35 of the third bevel wheel 34. As soon as the transverse shaft 30 is rotated, the spline sleeve 36 and the sliding block 42 are triggered to drive the second bevel wheel 32, which in turn drives the first bevel wheel 16 as well as the guiding screw rod 14 so as to force the moving block 18 to move to compress the coiled spring 26. In other words, as the transverse shaft 30 rotates progressively in one direction, the guiding screw rod 14 will rotate to cause the moving block 18 to keep moving toward the coiled spring 26, which is thus compressed further to generate a greater opposing force against an exerciser, as shown in FIG. 3. In addition, the third bevel wheel 34 remains idle.

Figure 4:
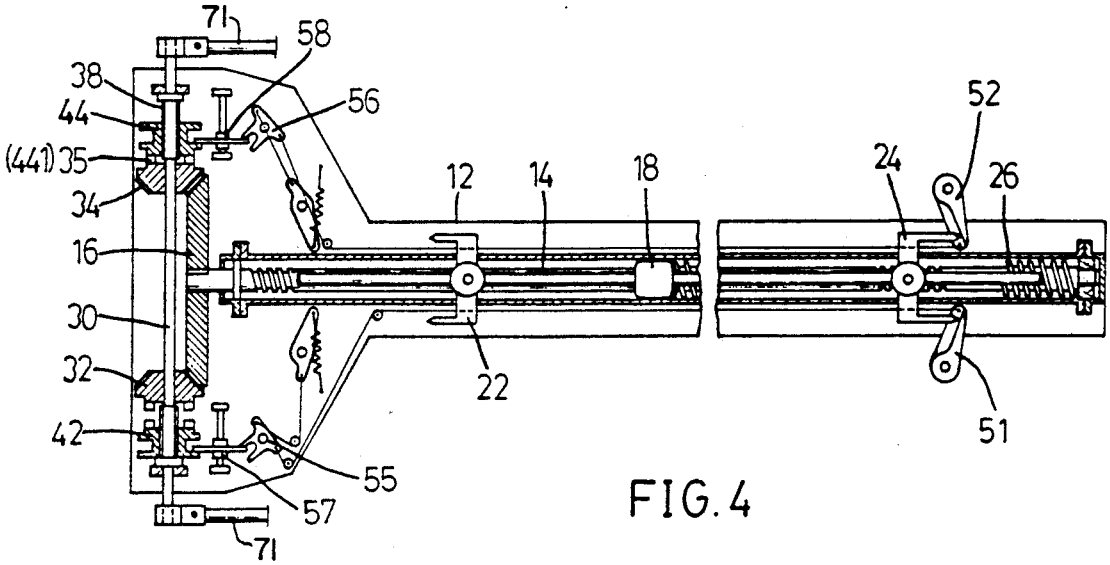
FIG. 4 shows a schematic plane view of the preferred embodiment of the present invention in a reversing state of action.

Now as shown in FIGS. 3 and 4, when the moving block 18 is driven to compress the coiled spring 26, the straight rod 20 on the moving block 18 moves accordingly. As a result, the collision element 22 is pulled away from the third and the fourth rocking levers 53 and 54 until such time when another collision element 24 actuates the first and the second rocking levers 51 and 52 to turn about, as shown in FIG. 4. In the meantime, the reacting cables 63 and 64 pull simultaneously the actuating elements 55 and 56, which will subsequently move counter-clock-wise, as shown in FIG. 4. As a result, the sliding pieces 57 and 58 trigger the sliding blocks 42 and 44 to move to bring about the disengagement of the clutch member 421 of the sliding block 42 with the clutch member 33 of the second bevel wheel 32. On the other hand, the clutch member 441 of the sliding block 44 engages with the clutch member 35 of the third bevel wheel 34, as shown in FIG. 4. If the transverse shaft 30 is rotated again at this time, it drives the guiding screw rod 14 to rotate in reverse via spline sleeve 38, the third bevel wheel 34 and the first bevel wheel 16 while the second bevel wheel 32 is idle. In other words, the reverse rotation of the guiding screw rod 14 results in a gradual relief of pressure exerting on the coiled spring 26 by virtue of the fact that the moving block 18 moves away from the coiled spring 26. As was mentioned previously, the straight rod 20 moves in conjunction with the moving block 18. Therefore, when the moving block 18 is moving away from the coiled spring 26, the straight rod 20 also moves in the same direction until such time when the straight rod 20 makes contact with the collision element 22, which is subsequently driven to actuate the third and the fourth rocking levers 53 and 54, as shown in FIG. 1, to complete one operational cycle.

It has become apparent that an exerciser's reciprocating motion of driving two rowing arms actuates the transverse shaft 30 to turn in one direction so as to initiate the rotation of the guiding screw rod 14, which in turn triggers the moving block 18 to move along the screw thread of the guiding screw rod 14 to compress the coiled spring 26 until such time when the intensity of recoil force of the compressed spring 26 has reached a predetermined degree. Thereafter, the reversing members are triggered by collision element 24 of the straight rod 20 to alter the direction, in which the guiding screw rod 14 turns, in order to bring about the retreat of the moving block 18 to release the compressed spring 26 until the reversing members are activated again. Therefore, the reciprocating actions of compressing and decompressing the coiled spring 26 result in a cyclic generation of a harmonic opposing force against an exerciser's hands. The cyclic generation of a harmonic opposing force can be easily adjusted by an exerciser by means of loosening the revolving buttons 23 and 25 to reposition the collision elements 22 and 24 on the straight rod 20.

Figure 5:
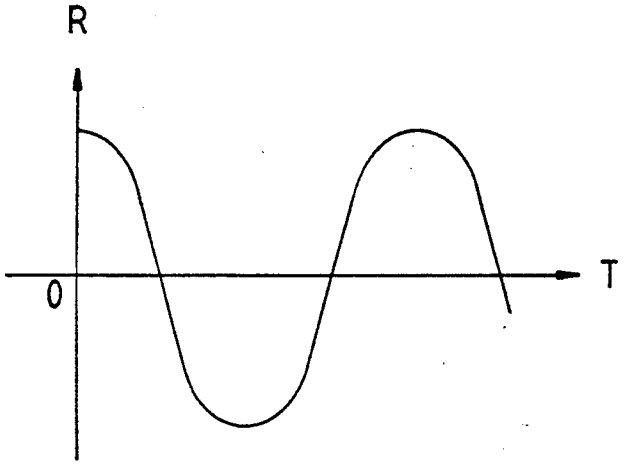
FIG. 5 shows a wave line representing the generating pattern of a harmonic opposing force against an exerciser's hands according to the present invention.

When the two rowing arms 71 are making a reciprocating motion, the transverse shaft 30 is driven to rotate unidirectionally. In other words, a reciprocating motion of two rowing arms 71 will bring about a gradual increase in the intensity of compression on the coiled spring 26 until such time when the predetermined maximum intensity has been reached. As a result, an exerciser would have to expend gradually an increasingly greater amount of energy to counter the resistance force which is being intensified gradually. Thereafter, the recoil force of the coiled spring 26 is gradually released and lessened so as to generate a cyclic effect, as illustrated in FIG. 5. In addition, the intensity of resistance force and the length of the cycle of effect can be easily adjusted by an exerciser by means of loosening the revolving buttons 23 and 25 to reposition the collision elements 22 and 24 on the straight rod 20.

The embodiment of the present invention described above is to be considered in all respects as merely an illustration of principles of the present invention. Accordingly, the present invention is to be limited only by the scope of the hereinafter appended claims.

I claim:

1. An exercise apparatus capable of generating harmonic resistance to an exercising user, comprising:

a base;

a guiding screw rod journalled on the base for reversible rotation about its own longitudinal axis; said guiding screw rod having two ends and a mid-section disposed intermediate said ends;

a first bevel gear secured on one said end of said guiding screw rod;

a compression coil spring encircling said mid-section of said guiding screw rod and having one end axially fixed in relation of the other said end of said guiding screw rod;

an axially movable block mounted on an opposite end of said compression coil spring and threadedly mounted on said guiding screw rod so as to be axially reversibly advanced along said longitudinal axis as said guiding screw rod is correspondingly reversibly rotated, whereby said compression coil spring is correspondingly variably compressed as said guiding screw rod is reversingly rotated;

a straight rod axially movably arranged on said base so as to be parallel to said guiding screw rod, said axially movable block being fixed on said straight rod at an intermediate location between two opposite ends of said straight rod;

two collision elements, including one mounted on said straight rod between said block and a forward end of said straight rod and the other mounted on said straight rod between said block and a rear end of said straight rod;

a transverse shaft journalled on said base for rotation about its own longitudinal axis, which is arranged perpendicularly to said longitudinal axis of said guiding screw rod;

spline sleeve means mounted on said transverse shaft for rotation therewith;

second and third bevel gears journalled on said transverse shaft, each having a respective clutch means;

first and second clutch members axially shiftably mounted on said spline sleeve means for rotation with said transverse shaft;

first and second shifting means respectively operatively associated with said first and second clutch members, respectively for shifting said first clutch member into and out of operative engagement with said clutch means of said second bevel gear, and said second clutch member into and out of operative engagement with said clutch means of said third bevel gear;

first and second rocking levers arranged to be engaged and rocked by said other collision element upon rearward axial travel of said straight rod due to rotation of said guiding screw rod in one direction;

third and fourth rocking levers arranged to be engaged and rocked by said one collision element upon forward axial travel of said straight rod due to rotation of said guiding screw rod in a direction opposite to said one direction;

cable means operatively associating said first shifting means with said first and third rocking levers and said second shifting means with said second and fourth rocking levers, so that as said first and second rocking levers are engaged and rocked by said other collision element said third bevel gear is operatively engaged with said first bevel gear, and said fourth bevel gear is disengaged from said first bevel gear, and, as said third and fourth rocking levers are engaged and rocked by said one collision element said fourth bevel gear is operatively engaged with said first bevel gear, and said third bevel gear is disengaged from said first bevel gear; and means actuable by an exercising user for rotating said transverse shaft, so that as said user continues to exercise and thereby rotate said transverse shaft, said guiding screw rod is rotated in said one direction thereby causing said spring to become progressively more compressed and thus offer progressively greater resistance to further rotation of said transverse shaft, until said first and second rocking levers are rocked by said other collision element, and then said guiding screw is rotated in said other direction thereby causing said spring to become progressively less compressed and thus offer progressively less resistance to further rotation of said transverse shaft, until said third and fourth rocking levers are rocked by said one collision element, so that as exercising time progresses simple harmonic resistance is provided to the user as the user uses the actuable means to rotate the transverse shaft.

2. The gymnastic apparatus of claim 1, further including:

means adjustably securing said collision elements to said straight rod, for permitting axial distances between said collision elements and said block to be selectively adjustably fixed.

* * * * *